US009999272B2

(12) United States Patent
Tompkins

(10) Patent No.: US 9,999,272 B2
(45) Date of Patent: Jun. 19, 2018

(54) APPARATUS, AND ASSOCIATED METHOD, FOR PROTECTIVELY SUPPORTING AN OBJECT

(76) Inventor: Blaine Kevin Tompkins, Burleson, TX (US)

( * ) Notice: Subject to any disclaimer, the term of this patent is extended or adjusted under 35 U.S.C. 154(b) by 862 days.

(21) Appl. No.: 13/191,312

(22) Filed: Jul. 26, 2011

(65) Prior Publication Data

US 2013/0026052 A1 Jan. 31, 2013

(51) Int. Cl.
*B65D 30/00* (2006.01)
*A42B 3/12* (2006.01)

(52) U.S. Cl.
CPC ..... *A42B 3/122* (2013.01)

(58) Field of Classification Search
CPC ..... A45C 11/02; A45C 11/00; B65D 85/18; B65D 5/5097; A42B 1/18
USPC ..... 206/8, 522, 592, 594; 220/232, 6, 62.21; 190/107; 383/3
See application file for complete search history.

(56) References Cited

U.S. PATENT DOCUMENTS 4,044,867 A * 8/1977 Fisher ..... A45C 7/004 190/107
4,482,054 A * 11/1984 Gardner ..... B65D 81/05 206/320
4,503,558 A * 3/1985 Lief ..... A45C 7/0081 383/13
4,573,202 A * 2/1986 Lee ..... A45C 3/00 190/107
4,905,835 A * 3/1990 Pivert ..... B65D 81/052 206/522
5,624,035 A * 4/1997 Kim ..... B65D 81/052 206/521
6,176,408 B1 * 1/2001 Miner ..... A42B 3/006 224/153
7,383,953 B2 * 6/2008 Dickinson ..... B65D 5/4233 206/522
2006/0021897 A1 * 2/2006 Dickinson ..... B65D 5/4233 206/521
2006/0207849 A1 * 9/2006 Sadow ..... A45C 7/0081 190/18 A
2008/0083640 A1 * 4/2008 Liu ..... A45C 13/021 206/522
2010/0294682 A1 * 11/2010 Choi ..... 206/320

* cited by examiner

*Primary Examiner* — Fenn C Mathew
*Assistant Examiner* — Cynthia Collado

(57) ABSTRACT

A protective support device for supporting an object, such as a pilot's helmet, protectively encloses and supports the object. The device includes an inner shell formed of a compressive material and of an inflatable bladder. The inner shell is positioned within an outer shell, such as a bag formed of a cloth, or other, material. An object to be supported is placed within the inner shell, and the inflatable bladder of the inner shell is inflated. Inflation of the inner shell encloses and surrounds the object.

17 Claims, 6 Drawing Sheets

APPARATUS, AND ASSOCIATED METHOD, FOR PROTECTIVELY SUPPORTING AN OBJECT

The present disclosure relates generally to a manner by which to protectively support an object, such as a pilot's helmet, a gun sight optic, or any other object that would benefit from protective support when not in use. More particularly, the present invention relates to an apparatus, and an associated method, that protectively supports the object when needed and that is otherwise collapsible into reduced dimensions when not used to support the object.

An inflatable bladder is positionable about the object, and the bladder is inflated to supportively enclose the object to protectively support the object. The bladder is deflated when not needed to protectively support the object. The bladder is inflatable about an object of any of various shapes and configurations.

BACKGROUND

Many devices utilize elements that are fragile and are susceptible to damage or breakage. And, care must be taken to prevent damage to such a device. Damage or breakage is possible, for instance, when the device is being carried or otherwise transported.

An exemplary device that includes fragile elements that are susceptible to breakage is a modern, aviator flight helmet.

The aviator flight helmet, like the aircraft he flies, has come a long way since the first powered flight over 100 years ago. Advances in helmet use and function have been driven by changing safety requirements, aircraft capability, technology and, at its base level, necessity.

In the early 1900s through the end of the WWII, the aviator's helmet was made of soft leather and intended mainly to protect from wind and cold. As advances in wireless radio communication developed, the leather helmet began to feature earphones for radio receivers. Later, as turbo-charging technology permitted higher aircraft operating altitudes, the oxygen mask attachment became standard as well. Early eye protection in the form of rubber-framed glass goggles were adopted from the fledgling days of manned flight as the most reasonable way to protect the eyes-especially in open-cockpit machines. As operating speeds became substantially increased with the advent of jet aircraft, rigid visors were developed as part of the helmet to protect aircrew from the deadly wind-blast effects of emergency ejection.

Over the years, the flight helmet has served first and foremost to protect the pilot's head in various situations: from bumps and scrapes on the flight line or in the cockpit, to the dangerous environment of an aircraft carrier deck, and more critical still in the case of high speed ejection. Like any piece of equipment however, man has found a way to make this device even more useful, combining functionality and advantage with the basic requirement of safety. But if we simply look at the last 25 years of the flight helmet's life, it seems to have stagnated technologically and thus, strayed little from its primary goal of protecting the pilot's head. Over this period most modern helmets have offered the following similar capabilities: protective outer shell, comfortable interior, attached visor, radio communication, source of oxygen, and add-ons like an attachment for a separate Night Vision Device (NVD). Although convenient and useful, few, if any, of these capabilities are absolutely critical to fly and employ the aircraft.

This has changed for the $4^{th}$ and $5^{th}$ generation of aircraft and resulted in a growth in the importance of the flight helmet as a source of combat advantage outside its basic protection role. In the latter stages of $4^{th}$ generation aircraft maturity, on platforms such as the F-15, F-16, F-18 and various foreign competitors, the development of a helmet mounted cueing system has changed the direction of flight helmet requirements and has begun a shift in the definition of its primary function. In a sense, tactical employment of the helmet's cuing system and the advantage gained by its use, have changed the focus of both construction and the role the helmet plays. Add to this the ability to see the video of an aircraft sensor (like IR Imagery) displayed on the visor, and the utility of the helmet increases dramatically. Both of these capabilities are available now on helmets such as the Joint Helmet Mounted Cueing System (JHMCS).

The helmet used on the F-35 Joint Strike Fighter will have all of these capabilities and more. In fact, the F-35 will no longer use the Heads-Up Display (HUD) that has become the standard in modern tactical jets. The critical information previously displayed on the HUD will now be contained in the helmet. The pilot will be able to access the information required to fly the aircraft almost regardless of where he is looking. This critical flight information will only be available in the helmet he wears, making it indispensible flight equipment. In addition, he will be able to use NVDs and various infrared cameras and display options, DAS (Distributed Aperture System), etc. without taking any additional gear to the aircraft, like is the norm at present. All of these options are contained within the flight helmet he carries to the jet. The trade off is that this new helmet has become a very sensitive and fragile piece of gear—more so than any other piece of gear he uses. Where the helmet once served merely to protect the pilot's head, the pilot will now, in some capacity, serve to protect his helmet. Gone are the days of careless handling and use of a fighter aircraft helmet. The pilot who now relies on this helmet to successfully fly and employ his aircraft will be acutely aware and concerned about the safety of this helmet while in transit to and from the aircraft as well as any other time he is not using it for flight.

It serves to reason that, like all technology, these improvements come at a price. What the pilot might have considered expensive for the previous helmet he wore will pale in comparison to the price tag on this new helmet—to an order of great magnitude. So another factor contributing to the critical nature of helmet protection is its extremely high price relative to past years and former helmet solutions—a fact that will be realized by both the end user and the numerous individuals and services responsible for acquisition and maintenance of these helmets. What is required is something to aid the pilot and technician in a mounting challenge to protect this helmet.

More generally, many other devices include elements that are fragile and are susceptible to damage or breakage. Analogous to the need to provide a better protective support for an aviator's flight helmet, there is also a need to provide improved protective support for other devices.

It is in light of this background information related to protective support devices that the significant improvements of the present invention have evolved.

DETAILED DESCRIPTION

Figure 1:
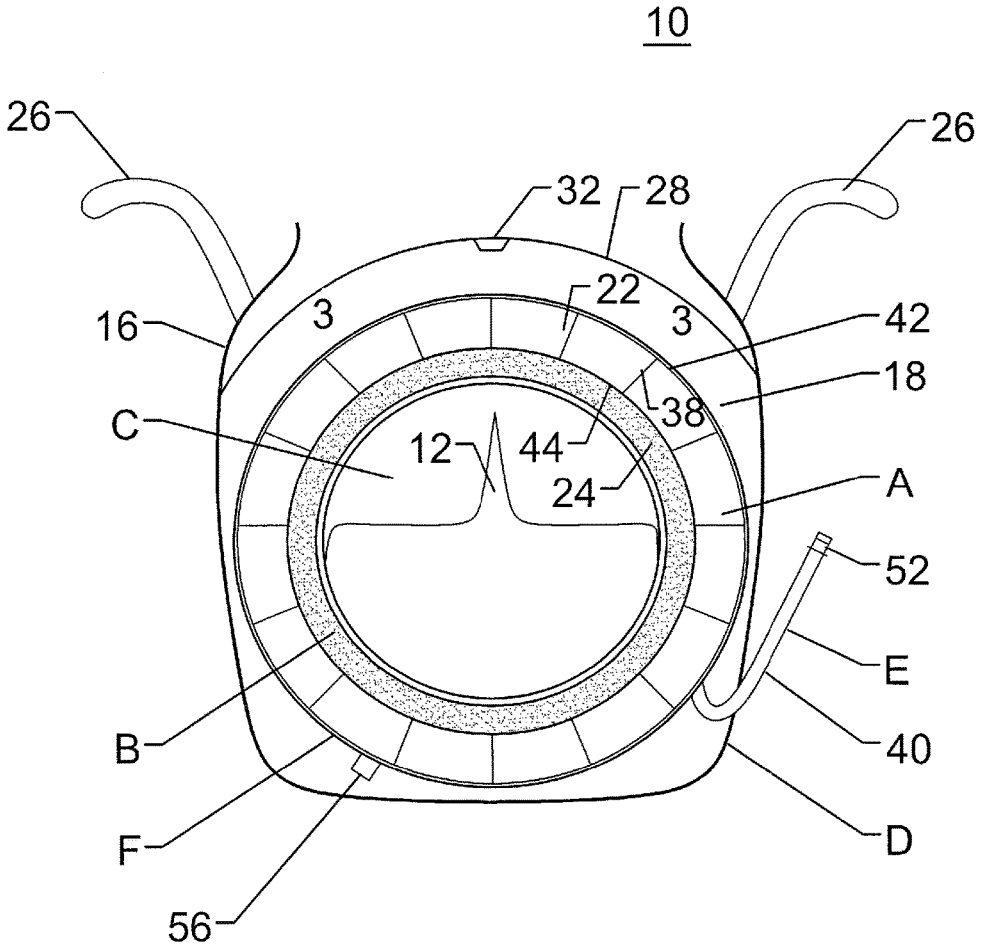
FIG. 1 illustrates a representation of the protective support device of an embodiment of the present invention.

The present disclosure, accordingly, advantageously provides an apparatus, and an associated method, by which to protectively support an object, such as a pilot's helmet, a gun sight optic, or any other object that would benefit from protective support when not in use.

Through operation of an implementation of the present disclosure, a manner is provided by which protectively to support the object, when needed, that is otherwise collapsible into reduced dimensions to facilitate storage when not in use.

In one aspect of the present disclosure, an inflatable bladder is positionable about an object. The bladder is inflated, thereby to supportively enclose the object in protective enclosure. When not in use to protectively support the object, the bladder is deflated to facilitate storage. The bladder is inflatable about an object of any of various shapes and configurations, sizes, and weights.

In another aspect of the present disclosure, an outer shell is positionable about an inner shell that includes an inflatable bladder. The outer shell comprises, for instance, a closable bag.

In another aspect of the present disclosure, the outer shell comprises a support bag, which is of a configuration to permit its hand carriage when used to transport an object supportably enclosed therein. In another aspect of the present disclosure, the support bag includes other mechanisms that permit carriage of the support bag, e.g., in alternate implementations, shoulder straps, belt loops, clothing pockets, etc. are utilized.

In another aspect of the present disclosure, an inner shell is provided that is positionable within an outer shell. The inner shell includes an inflatable bladder that is inflatable into an inflated configuration and is collapsible into a non-inflated configuration.

In another aspect of the present disclosure, the inflatable bladder is inflatable into the inflated configuration through the application of an inflation fluid into the inflatable bladder, such as inflation air. The inflatable bladder is configurable to be positionable about an object that is to be protectively supported, thereby to protectively support the object there within.

In another aspect of the present disclosure, an inner shell is provided that includes a compressible-material sheet. The compressible-material sheet comprises, for instance, a memory foam material.

In another aspect of the present disclosure, a manner is provided by which to store the support bag in a smaller space when not in use. This capability, to be inflated and protective, is paired with the capability to be deflated and easily stored. The net result is the essence of the embodiment where the device is continually inflated and deflated to meet the need of either protection or storage, where both states are a requirement or advantage of device depending on the situation.

In another aspect of the present disclosure, an inflatable bladder is provided that includes an inflation-fluid receiving port. And, an inflation fluid applicator is connectable to the inflation-fluid receiving port to apply inflation fluid to inflate the inflatable bladder. In an alternate implementation, the inflation is manually carried out, e.g., with user exhalations.

In another aspect of the present disclosure, the inflatable bladder includes a pressure relief valve. The pressure relief valve is configured to open when a pressure level within the inflatable bladder exceeds a pressure threshold.

In another implementation, the object that is supported is of any of various other elements and the device comprises, e.g., a standard NVG case, a rifle scope protector, a gun case, a spotting scope case, a laser, e.g., MULE, case, a UAV case, a radio or other electronic device case, a cruise box, an explosives case, an inflatable cranium protector for flight deck operation, a fragile medical/component case for field or base logistics, a civilian-use helmet bag, a camera case, a camera lens case, a computer case, a guitar case, an instrument case, a shipping case for sensitive/valuable, i.e., heart pace-maker, or any valuable/sensitive piece, a laser or sensitive device like that used in surveys or elevation calibration, a ship borne storage, a snow board cover, an IPOD cover, a digital book cover, a portable GPS cover, a wine bottle/glass protector-mobile-like device that packs 2 glasses and a bottle of wine for a hike, with shoulder straps, etc., a portable FLIR/NVG civilian application, and a camping gear, i.e., lantern.

In one implementation, a pilot's helmet used by a jet, prop or helicopter pilot is protectively supported. The helmet is, e.g., seated, or otherwise placed, upon an inner shell that includes an inflatable bladder and that is positioned within an outer shell. Once so-positioned, the inflatable bladder is inflated, such as through connection of an air hose that supplies air pressure to inflate the bladder or through manual inflation. As the bladder is inflated, the bladder becomes positioned about the helmet, thereby to protect the helmet from external forces that might subsequently be exerted thereon. The outer shell, comprises, for instance, a closable bag. When the closable bag is closed and includes handholds, facilitating hand carriage of the outer shell, inner shell, and helmet supported therein.

In these and other aspects, therefore, an apparatus, and an associated method, is provided for protectively supporting an object. An outer shell is provided. And, an inner shell is positioned within the outer shell. The inner shell includes an inflatable bladder that, when the object is seated at the inner shell and an inflation fluid is provided to inflate the inflatable bladder, the inflatable bladder becomes positioned about the object, thereby to protectively support the object.

Turning first, therefore, to FIG. 1, a protective support enclosure, shown generally at 10, provides for support of an object 12, here a pilot's helmet, in supportive enclosure when supported in the protective support device, the object 12 is protected from damage caused, e.g., external forces that might otherwise damage the object if not suitably protected.

In the exemplary implementation shown in the figure, the pilot's helmet, which forms the object 12, includes electronic and optical devices that are susceptible to breakage. When supported by the protective support device 10, the possibility of damage to the helmet, or parts thereof, is reduced. Dropping of the protective support device, while being carried, or blunt forces generated if the protective support device strikes an object while being carried is less likely to result in damage to the helmet than if carried in a conventional flight bag, or the like.

While the following description shall describe exemplary operation of the support device 10 shall be described with respect to the exemplary implementation in which the object 12 forms a pilot's flight helmet, in other implementations, the support device 10 is configured to protectively support and permit carriage of other types of objects. The following description is therefore by way of example. In such other implementations, the protective support device is analogously operable, with appropriate change in configuration depending upon the configuration of the object that is to be supported.

The support device 10 includes an outer shell 16 and an inner shell 18. The inner shell 18 includes an inflatable bladder 22 and a compressible-material sheet 24. The compressible-material sheet 24 comprises, for instance, a sheet of memory foam material.

The outer shell 16, in the exemplary implementation, comprises a cloth, or other material, bag that contains handles 26 that facilitate hand-carriage of the support device. The outer shell 16 here also includes a top side 28 having a zippered closure 32.

The inflatable bladder is formed of a plurality of bladder sections 36 in which separate ones of the bladder sections are separated from one another by common bladder walls 38 extending between top and bottom bladder walls 42 and 44. The bladder is inflatable through application of an inflation fluid, here inflation air provided by way of an inflow, inflation-fluid receiving port 48. An air pump 52 is here represented to provide the inflation air to the port 48. In the exemplary implementation, the air pump comprises a separate, free-standing unit. In another implementation, the pimp comprises an attached mechanical or electrical pump. The bladder 22 is inflated in the illustration of FIG. 1, and the bladder, together with the compressible material sheet 24 supportively encloses the object 12 about all of its sides. Forces exerted against the support device are absorbed by the bladder 22 and the compressible material sheet 24 to protect the object 12 protectively supported there within.

The port 48 comprises a tube that, in the exemplary implementation, extends through an opening formed in the outer shell 16 to provide for ease of access for purposes of inflation and disinflation. Additionally, the inflatable bladder includes a valve 56 that forms a blow-off valve that opens in the event that the pressure in the bladder exceeds an allowable pressure level. When the pressure exceeds the permitted pressure level, the valve 56 opens until the pressure level is reduced to an acceptable level. The object 12 is placed into an open, inner shell that is positioned within the outer shell 16. The inner shell is then enclosed and sealed to enclose the top and sides of the object 12 in addition to the bottom side of the object. The inner shell 18 is held in the enclosed position through use of, e.g., a Velcro™ strip (not separately shown in FIG. 1). And, once enclosed, the inflatable bladder 22 is inflated through application of the inflation fluid by way of the port 48. The object 12 is thereby snuggly positioned in a protective manner by the compressible material sheets 24 and the bladder 24, once inflated.

In one implementation, the inner shell and, thus, the object 12, is held firmly in place by the Velcro strip. Additionally, a strip of Velcro™ material positioned at a bottom of the inflatable bladder engages with a corresponding strip formed on an inner, bottom side of the outer shell 16.

Once so-positioned, the outer shell is closed, here by zippering-shut the zipper enclosure 32 of the top side of the outer shell. In one implementation, an elastic band with a plastic securing member is further utilized, further to secure the entire bag and shell combination. The elastic securing element is also used, further to secure the entire bag and shell combination. The elastic securing element also serves an additional purpose of achieving a smaller, more compact, complete package when the bag is not being used as a protective device. Hand-carriage of the support device is facilitated through use of the handles 26 that, here, are formed of a nylon material, the same material forming the outer shell 16 in the exemplary implementation. In one implementation, shoulder straps (not shown) are utilized to permit carriage in a fashion analogous to that of a backpack. Hands-free conveyance of the object 12 and the device 10 is provided.

Figure 2:
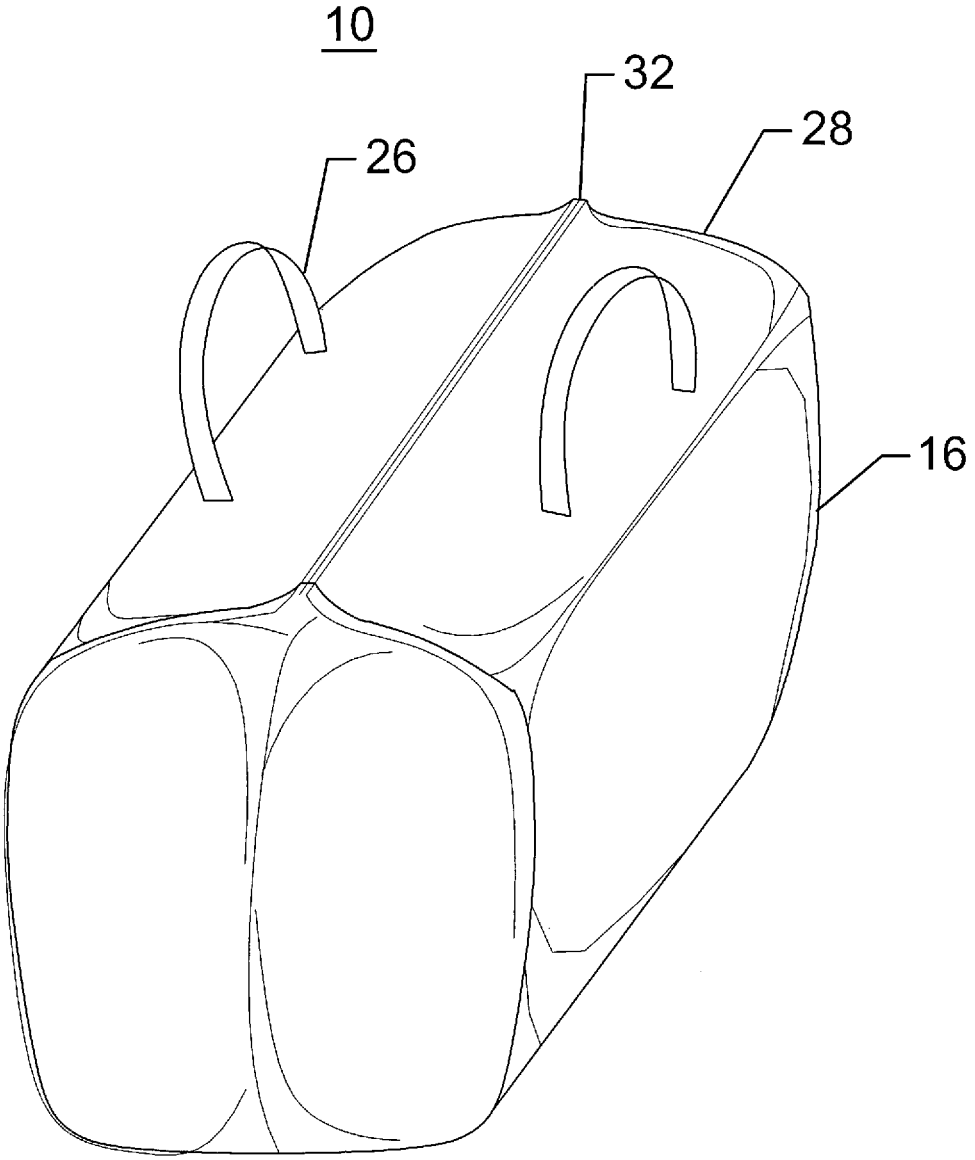
FIG. 2 illustrates another representation of the protective support device shown in FIG. 1, here when the protective support device is in a closed configuration, such as to permit hand carriage of a device supportively protected in the protective support device.

Turning next to FIG. 2, the protective support device 10 is again shown. In the illustration of FIG. 2, the protective support device is in a closed configuration. That is to say, the support device 10 holds the object 12 (shown in FIG. 1), and the zippered closure 32 of the top side 28 of the outer shell 16 is in a closed position to supportively enclose the object there within.

In the exemplary implementation, the support device 10, when in the illustrated, closed configuration, takes the shape of a bag having generally square side walls and a somewhat rounded top portion. Also, in the exemplary implementation, the outer shell 16 of the device 10 is of somewhat greater lengthwise dimensions than height wise dimension, and the height wise dimensions are somewhat greater than the depth wise dimensions.

The outer shell 16 serves to support, reinforce, and carry the inner shell and the object, there within. While the exemplary implementation utilizes a zippered closure 32, in other implementations, the outer shell is secured in a closed configuration utilizing other closure mechanism, such as Velcro™. The outer shell is constructed of a durable material, such as nylon, that is collapsible when the protective device 10 is not utilized to store an object there within. The handles 26 are again shown in FIG. 2 to facilitate hand-carriage of the protective support device. As mentioned previously, in a further implementation, the outer shell further includes straps to permit carriage of the device 10 in a manner analogous to that of a backpack. Additionally, in a further implementation, the outer shell further defines external pockets, available for use to carry items, such as flight manuals, publications, and small equipment devices, available from the exterior of the device 10.

In the exemplary implementation, the outer shell 16 is made of a durable and flexible material that is not necessarily stretchable. The outer shell provides a resistance required against the inflating of the inner shell (shown in FIG. 1) that permits the inner shell to conform completely to the object that is to be supported. The bag formed of the outer shell provides the outer resistance to the inflation of the inflatable bladder of the inner shell to force the inner shell, both the bladder and the compressible material to fill in voids in and around the object to be supported rather than continuing to expand in outward directions away from the object.

Figure 3:
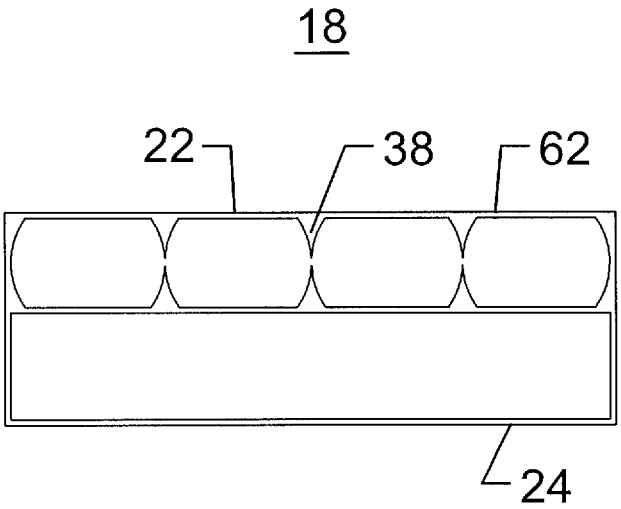
FIG. 3 illustrates a cross-sectional representation of a portion of the protective support device shown in FIGS. 1-2.

FIG. 3 illustrates a portion of the inner shell 18 of the protective support device 10 shown in FIGS. 1-2. The inner shell is again shown to be formed of an inflatable bladder 22 having a plurality of bladder sections 36 defined by bladder walls 38. And, the compressible material sheet 24 is shown to be directly beneath (as shown) the inflatable bladder 22.

The bladder 22 is constructed of a durable and flexible material and is sealed around an outer perimeter such that the bladder is air tight, fully inflatable and deflatable. The bladder walls form seals within the bladder, at uniform intervals, both horizontally and vertically, that define columns when the bladder is inflated. The bladder walls 38 further include small spans or gaps that permit air to flow between adjacent columns. The air flow facilitates inflation of the bladder and provides for the redirection and resultant dissipation of energy when forces are exerted upon the support device, thereby to facilitate protection of the object supported in the support device.

The compressive material sheet 24 is positioned beneath the bladder and is positionable to abut against the object (shown in FIG. 1) that is to be protected. The sheet 24 conforms to the configuration of the object that is to be supported, filling voids and creating a tailored fit between the bladder and the object. The compressive material sheet 24 provides additional general protection and also provides protection prior to inflation of the inflatable bladder. Support is also provided in the event of rupture or other deflation of the inflatable bladder. When stored, the compressible material is compressed to minimize its dimensions for storage.

The inner shell here further illustrates a shell cover 62. The shell cover 62 encloses both the inflatable bladder 22 and the compressible material sheets 24. The shell cover functions to maintain the bladder and material sheet in alignment with one another. Additionally, the cover 62 provides resistance to the inflatable bladder so that the entire shell fits uniformly and snuggly around the object that is to be supported. In one implementation, the shell cover 62 includes a Velcro™ strip that is mated with a corresponding sheet of Velcro™ formed at a bottom portion of the outer shell (shown in FIGS. 1-2) to maintain the inner shell in position. In one implementation, there are additional strips of Velcro™ at the sides and front and back sides that connect with corresponding strips of the outer shell. The shell cover 62 is formed of a durable and soft material that contacts the object to be supported without scratching or abrasion. The material of the shell cover 62 is of dimensions, or stretchable into dimensions, to fully accommodate inflation of the inflatable bladder while restricting the overall size and maintaining a tight fit between the inner shell and the object to be protected.

In one implementation, the inner shell, the inflatable bladder, and the compressible material sheet are inserted into the shell cover 62 by way of a seam formed in a back of the shell cover that extends vertically along a longest span of the back of the shell cover. The seam is closable also, e.g., utilizing a Velcro™ strip.

Figure 4:
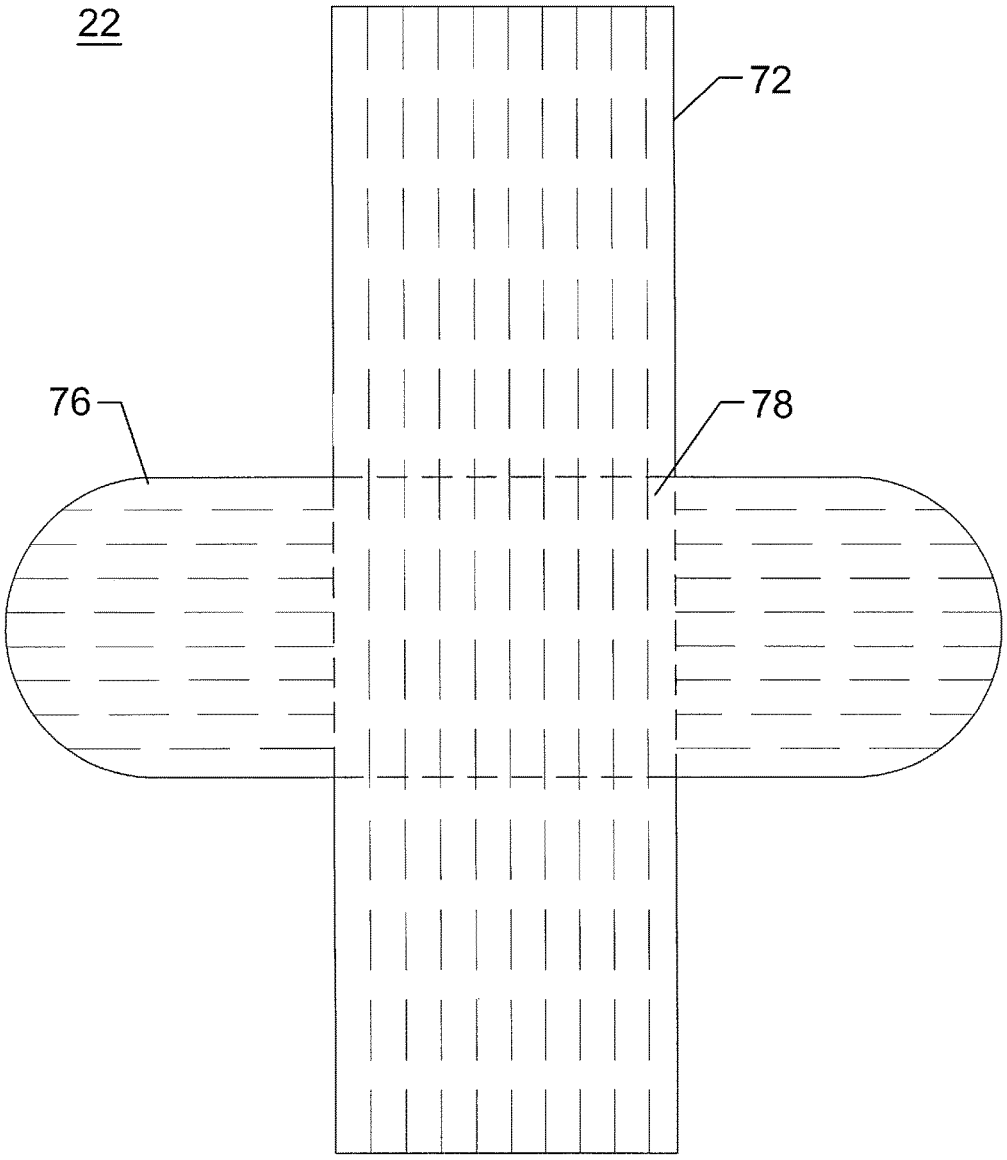
FIG. 4 illustrates a view of an inflatable bladder, prior to inflation, that forms a portion of the protective support device shown in FIGS. 1-3.

FIG. 4 illustrates the inflatable bladder 32 of an embodiment of the present invention. The bladder 32 is illustrated in an uninflated configuration prior to application of an inflation air, or other fluid. As described previously, the inflatable bladder 32 is inserted into an outer shell 16 (shown in preceding figures), and is inflated to surround and object that is to be protectively supported.

The inflatable bladder 32 is comprised of a durable and flexible material and is sealed around its outer perimeter such that the inflatable bladder is air tight, fully inflatable and deflatable. Bladder walls that define bladder sections within the bladder. When inflated, the bladder is of substantially uniform height. As described previously, inflation fluid provided to the inflatable bladder by way of an inflow fluid port 48 (shown in FIG. 1) that is of a configuration permitting intake of fluid while maintaining the air tight integrity of the bladder. In one implementation, the port forms a one-way valve until the inflatable bladder is to be deflated. The valve is opened to permit fluid contained in the bladder to be released. In one implementation, the bladder further includes a pressure relief valve 56 (also shown in FIG. 1) that opens in the event that internal pressure within the bladder exceeds a selected level. In one implementation, the port 48 and the relief valve 56 comprise a common element. The valve forming the port, in one implementation is locked into an open position to deflate the bladder and to provide for fire flow of fluid during ambient pressure changes, e.g., when an aircraft changes altitude. When locked in the open position, the bag will not self-inflate as a result of decreasing pressure or create too great of a vacuum when pressure increases.

In the view of FIG. 4, the inflatable bladder 32 is initially of a "T" or cross shape. The bladder includes a longitudinally-extending part 72 and a horizontally-extending part 76 having overlapping portions 78. In the exemplary implementation, the longitudinally-extending portion 72 is aligned with the lengthwise dimension of the outer shell (shown in FIGS. 1-2) and is inserted into the outer shell. The horizontally-extending portion 76 defines side pieces that are folded against side walls of the outer shell. The dimensions of the longitudinally-extending portions include portions that analogously are folded to abut against end walls of the outer shell and further folded to extend along a top side of the outer shell, thereby to provide for enclosure of the object about all sides. In the exemplary implementation, Velcro™ strips are utilized to maintain the outer shell in position.

During assembly, after insertion of the inflatable bladder 32 into the outer shell, the compressible material sheet 24 (shown in FIGS. 1 and 3) is also inserted into the outer shell and placed to abut upon the inflatable bladder. Then, the object that is to be supported is also placed in the outer shell, seated upon the compressible material sheet and, in turn, the inflatable bladder.

FIGS. 5A-5D again illustrates the protective support device 10 of an embodiment of the present invention. As described previously, the device 10 is used to protectively support an object there within and to facilitate carriage thereof. When not in use to support the object, the device 10 is collapsible into reduced dimensions. By collapsing the support device into the reduced dimensions, the device requires less space when stored. In the exemplary implementation in which the support device is used to supportively enclose and protect a pilot's helmet, when the helmet is removed from the support device and used, such as when the pilot wears the helmet during flight operations, the support device is collapsible into reduced dimensions, thereby to facilitate transport of the support device. If the space available to transport items is minimal, such as in fighter aircraft having small cockpits and limited storage space available in a cockpit, the capability to reduce the dimensions of the support device, when not used, is a significant advantage. Thereby, in addition to protection of an object, the support device is further collapsible when not in use to facilitate compact storage.

Figure 5A:
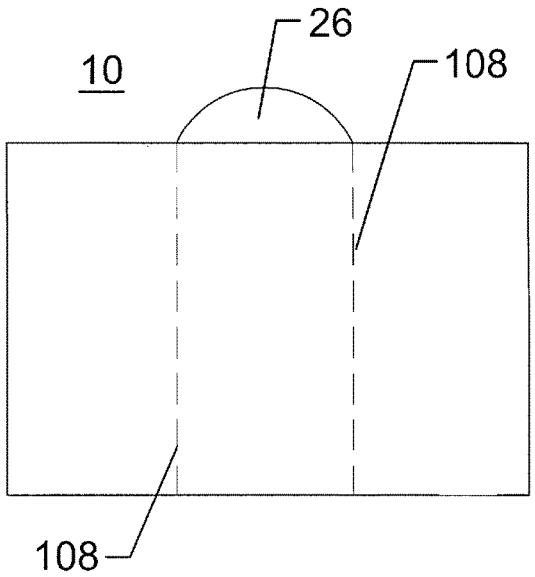
FIGS. 5A-D illustrates a representation of the protective support device, foldable into a storage position when not being used to supportively protect an object.
Figure 5B:
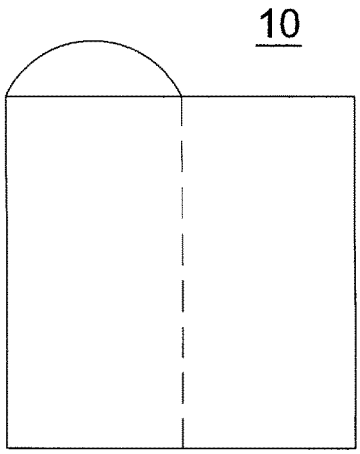

FIG. 5A illustrates the support device 10, configured prior to collapsing into reduced dimension. In the illustration of FIG. 5A, no object is supported in the support device, and the inflatable bladder (shown in previous figures) has been disinflated. Fold lines 108 represent locations at which to fold the support device when collapsing the device into reduced dimensions. FIG. 5B illustrates the support device when the support device is folded about the left-most (as shown) fold line 108 of FIG. 5A. The dimensions of the support device in a longitudinal direction are reduced by a third.

Figure 5C:
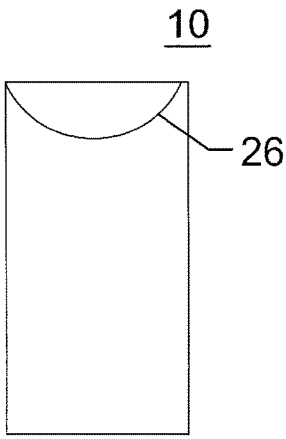

FIG. 5C illustrates the support device 10 when a second fold, along the right most (as shown) fold line 108 shown in FIG. 5A has been made. In this configuration, the support device is ⅓ of the lengthwise dimension shown in FIG. 5A.

Figure 5D:
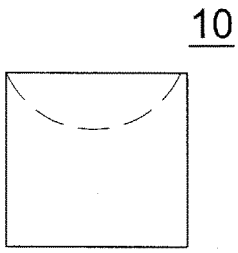

FIG. 5D illustrates the support device 10 when folded in half, relative to the configuration shown in FIG. 5C. Comparison of FIG. 5D with FIG. 5A illustrates that the folding of the support device reduces its dimensions to be ⅙ that of the dimensions of the support device shown in FIG. 5A.

Figure 6:
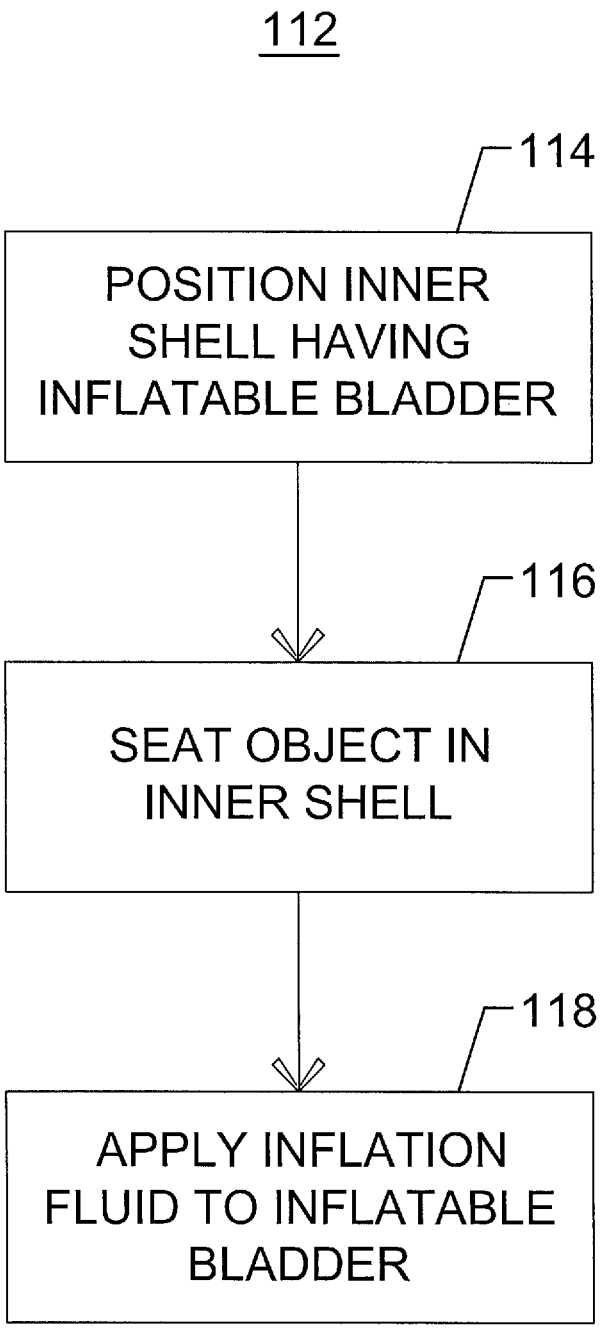
FIG. 6 illustrates a method flow diagram representative of the method of operation of an embodiment of the present invention.

FIG. 6 illustrates a method 112 representative of the method of operation of an embodiment of the present disclosure. The method facilitates protective support of an object.

First, and as indicated by the block 114, an inner shell having an inflatable bladder in an outer shell is positioned. Then, and as indicated by the block 116, the object is seated at the inner shell. And, as indicated by the block 118, an inflation fluid is applied to the inflatable bladder to position the inflatable bladder about the object and thereby protectively support the object.

When no longer required to support the object, the object is removed, the inflation fluid is removed from the inflatable bladder, and the outer shell, and inner shell therein, is folded into a storage position.

Presently preferred implementations of the disclosure and many of its improvements and advantages have been described with a degree of particularity. The description is of preferred examples of implementing the disclosure, and the description of examples is not necessarily intended to limit the scope of the disclosure. The scope of the disclosure is defined by the following claims.

What is claimed is:

1. An apparatus for protectively supporting an object, said apparatus comprising:

an outer shell comprising a support bag and formed of a nonstretchable material; and an inner shell positioned within said outer shell, said inner shell comprising an inflatable bladder that, when the object is seated at said inner shell and an inflation fluid is provided to inflate the inflatable bladder, resistance, caused by the outer shell to outward expansion of the inflatable bladder, preventing the outward expansion of the inflatable bladder and forcing the inflatable bladder into position to fill in voids around the object and to conform to and to protectively support the object, said outer shell supporting and carrying said inner shell and the object when the object is seated at said inner shell, said outer shell and said inner shell together collapsible when not in use into reduced dimension to facilitate compact storage, the support bag of said outer shell of configuration permitting hand carriage thereof together with said inner shell and the object supported therein.

2. The apparatus of claim 1 wherein said outer shell comprises a closeable bag.

3. The apparatus of claim 1 wherein said inner shell further comprises a compressible-material sheet.

4. The apparatus of claim 3 wherein the compressible-material sheet is comprised of a memory foam material.

5. The apparatus of claim 1 wherein the inflatable bladder further comprises an inflation-fluid receiving port.

6. The apparatus of claim 5 further comprising an inflation fluid applicator connectable to the inflation-fluid receiving port to apply the inflation fluid to inflate said inflatable bladder.

7. The apparatus of claim 1 wherein, when the object is seated at said inner shell and the inflatable bladder, the inflatable bladder is positioned to surround the object.

8. The apparatus of claim 1 wherein the object comprises a helmet and wherein said outer shell and said inner shell are of configurations permitting positioning there within of the helmet.

9. The apparatus of claim 8 wherein the helmet is seated at said inner shell, said inner shell capable of being deflated.

10. An apparatus for protectively supporting an object, said apparatus comprising:

an outer shell formed of a nonstretchable material; and an inner shell positioned within said outer shell, said inner shell comprising an inflatable bladder that, when the object is seated at said inner shell and an inflation fluid is provided to inflate the inflatable bladder, resistance, caused by the outer shell to outward expansion of the inflatable bladder, preventing the outward expansion of the inflatable bladder and forcing the inflatable bladder into position to fill in voids around the object and to conform to and to protectively support the object, said outer shell supporting and carrying said inner shell and the object when the object is seated at said inner shell, and said outer shell and said inner shell together collapsible when not in use into reduced dimension to facilitate compact storage, said inner shell comprising a pressure relief valve configured to open when a pressure level within the inflatable bladder exceeds a pressure threshold.

11. A method for protectively supporting an object, said method comprising;

positioning an inner shell in a support bag, the inner shell having an inflatable bladder in an outer shell, the outer shell formed of a nonstretchable material;

seating the object at the inner shell; and applying an inflation fluid to the inflatable bladder the outer shell positioned to resist outward expansion of the inflatable bladder and to force the inflatable bladder into position to fill in voids around the object and to conform the inflatable bladder to the object, thereby to protectively support the object, the outer shell supporting and carrying the inner shell and the object when the object is seated at the inner shell, the outer shell and the inner shell together collapsible, through release of the inflation fluid, when not in use into reduced dimensions to facilitate compact storage, and the support bag of configuration permitting hand carriage of the support bag together with the inner shell and the object supported therein.

12. The method of claim 11 wherein said positioning comprises positing the inner shell in a closeable bag.

13. The method of claim 11 wherein said positioning comprises positioning an inner shell having the inflatable bladder and a compressible-material sheet in the outer shell.

14. The method of claim 13 wherein the compressible-material sheet comprises a memory foam material.

15. A method of claim 11 wherein said applying comprises applying the inflation fluid to an inflation fluid receiving port.

16. The method of claim 15 wherein said applying further comprises connecting an inflation fluid applicator to the inflation fluid receiving port.

17. The method of claim 11 further comprising release inflatable bladder when a pressure level within the inflatable bladder exceeds a pressure threshold.

* * * * *